US007367270B2

(12) United States Patent
Perry, Jr.

(10) Patent No.: US 7,367,270 B2
(45) Date of Patent: May 6, 2008

(54) ISOLATION MOUNTING SYSTEM FOR RAILROAD CAR STEPS AND RUNNING BOARDS

(75) Inventor: John R. Perry, Jr., Elm Grove, WI (US)

(73) Assignee: Railroad Steps & Boards, LLC, Elm Grove, WI (US)

( * ) Notice: Subject to any disclaimer, the term of this patent is extended or adjusted under 35 U.S.C. 154(b) by 0 days.

(21) Appl. No.: 11/451,267

(22) Filed: Jun. 12, 2006

(65) Prior Publication Data

US 2006/0230978 A1 Oct. 19, 2006

Related U.S. Application Data

(63) Continuation of application No. 10/775,412, filed on Feb. 10, 2004, now Pat. No. 7,089,870.

(60) Provisional application No. 60/491,410, filed on Jul. 31, 2003.

(51) Int. Cl.
*B61C 17/04* (2006.01)

(52) U.S. Cl. ..... 104/457

(58) Field of Classification Search ..... 105/457, 105/396, 238.1; 280/153 R, 163
See application file for complete search history.

(56) References Cited

U.S. PATENT DOCUMENTS

| | | | | |
|---|---|---|---|---|
| 2,208,021 A * | 7/1940 | Delanty | 105/457 |
| 4,167,272 A | 9/1979 | Wright et al. | 280/163 |
| 4,601,623 A | 7/1986 | Wallace | 411/336 |

* cited by examiner

*Primary Examiner*—S. Joseph Morano
*Assistant Examiner*—Robert J. McCarry, Jr.
(74) *Attorney, Agent, or Firm*—Andrus, Sceales, Starke & Sawall, LLP

(57) ABSTRACT

A mounting system is provided for securing a metal support surface to a metal bracket on a railroad car. The invention is improved by a compressible, energy absorbing arrangement secured intermediate the support surface and the bracket for preventing metal to metal contact between the support surface and the bracket and absorbing vibrational energy caused by movement of the railroad car.

11 Claims, 7 Drawing Sheets

FIG. 1
PRIOR ART
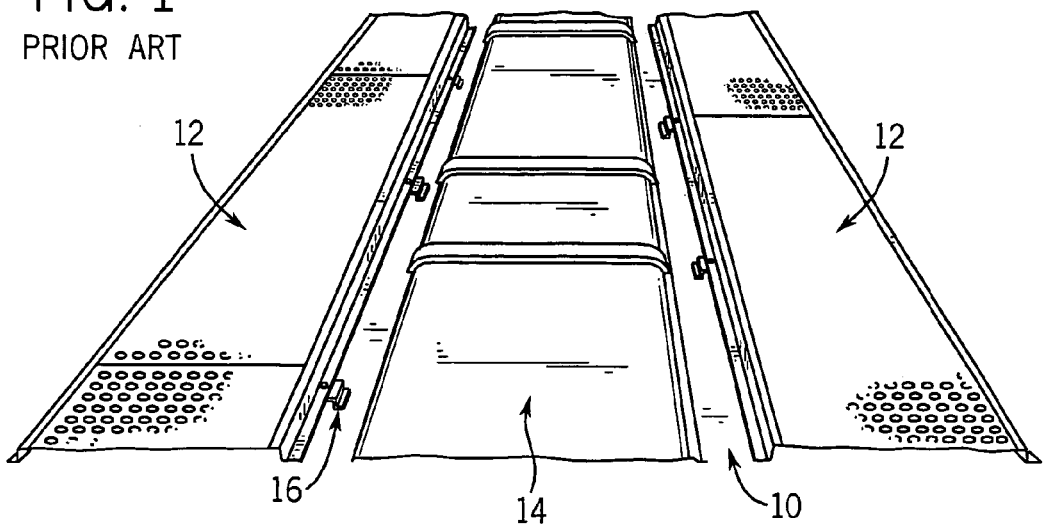
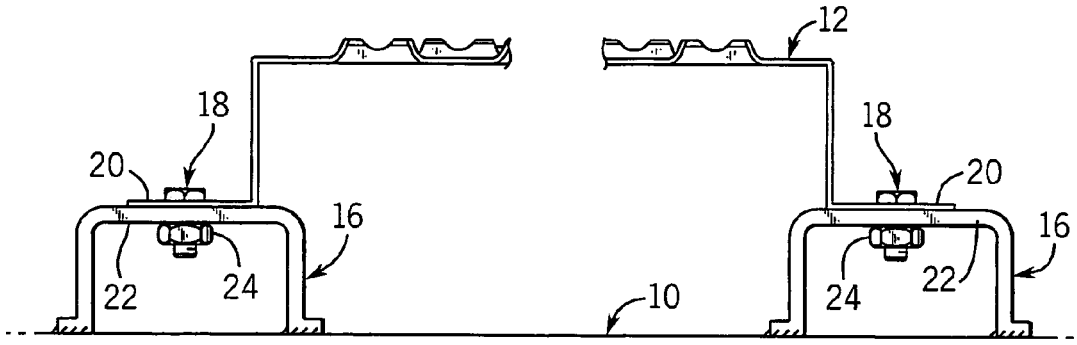
FIG. 2
PRIOR ART
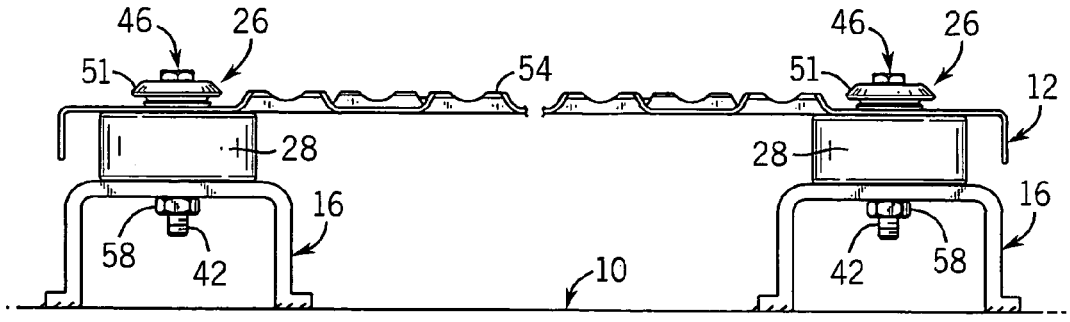
FIG. 7

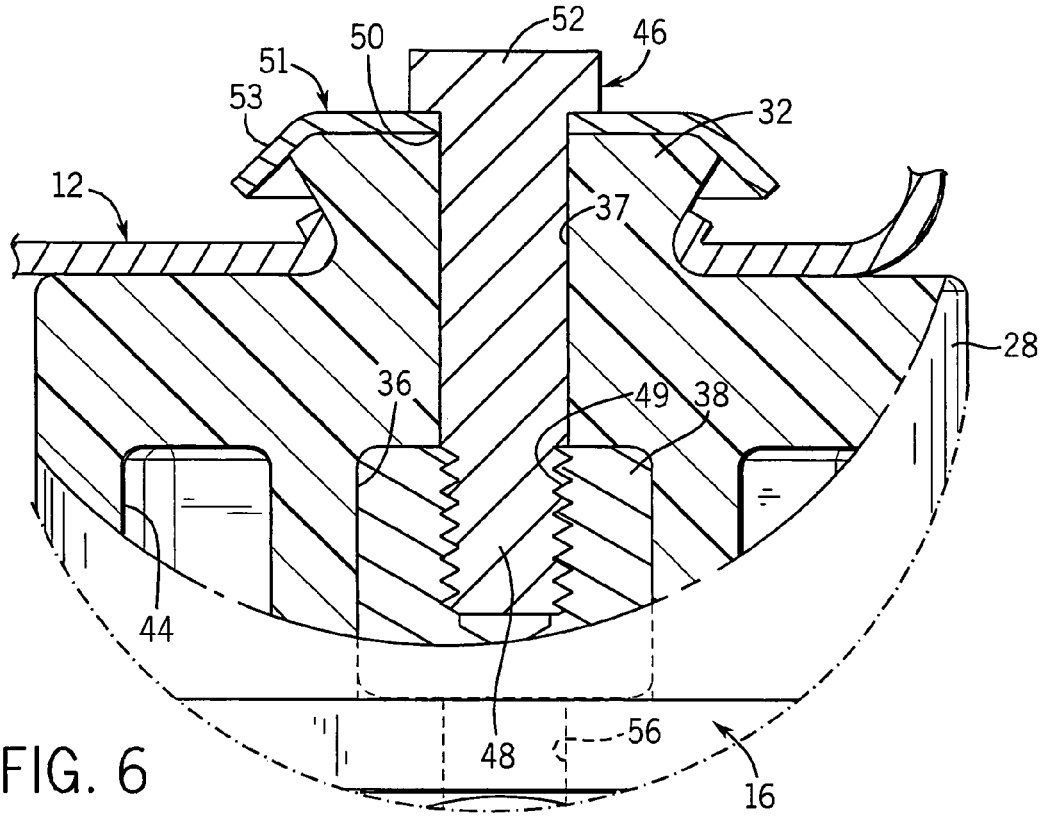
FIG. 6
FIG. 8a
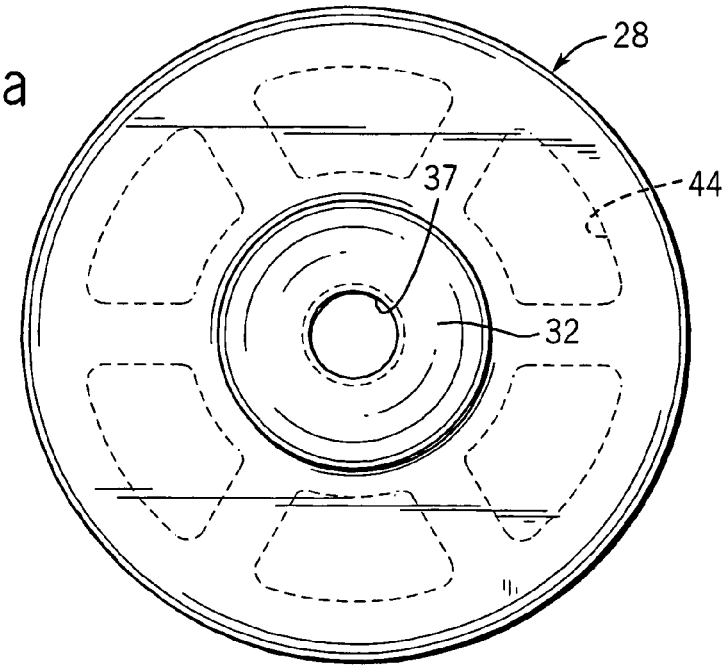

ISOLATION MOUNTING SYSTEM FOR RAILROAD CAR STEPS AND RUNNING BOARDS

CROSS-REFERENCES TO RELATED APPLICATION

This continuation application is related to prior application Ser. No. 10/775,412, filed on Feb. 10, 2004, now U.S. Pat. No. 7,089,870, of John R. Perry, Jr. for Isolation Mounting System For Railroad Car Steps And Running Boards, which is related to and claims priority from U.S. Provisional Application No. 60/491,410 filed on Jul. 31, 2003.

FIELD OF THE INVENTION

The present invention relates generally to the attaching of support surfaces on railroad cars and, more particularly, pertains to a fastening system used for mounting railroad car steps and running boards to a railroad car.

BACKGROUND OF THE INVENTION

Railroad cars are typically provided with support surfaces, such as various steps and running boards, to enable personnel to access different areas onboard. Currently, these steps and running boards are manufactured from metal and are mounted by simple nut and bolt fasteners to metal brackets fixedly attached to surfaces of the railroad cars. A problem with metal to metal contact arises as the railroad cars travel along the rails creating twisting, torquing and excess harmonic vibration. These forces seriously fatigue the metal components and lead to cracking thus shortening the life of the steps and the running boards.

Accordingly, it is desirable to alleviate the deficiencies of the prior art support surface attachment on railroad cars, and provide a mounting system which protects steps and running boards from the destructive vibrational energy caused by movement of the cars.

SUMMARY OF THE INVENTION

It is a general object of the present invention to provide a system for mounting steps or running boards on a railroad car in a manner that avoids, or minimizes, fatigue and cracking.

It is also an object of the present invention to provide a mounting system that greatly reduces the vibrational forces transmitted to steps and running boards attached to railroad cars.

It is another object of the present invention to provide a mounting system employing an energy-absorbing, compressible bushing interposed between a step or running board and a railroad car.

It is an additional object of the present invention to provide a mounting system capable of being interchanged for existing fastening systems between a railroad car support surface and a bracket on the railroad car.

It is a further object of the present invention to provide a step or running board mounting system for a railroad car in which no metal fastener is in direct contact with the metal of the step or running board.

In one aspect of the invention, a mounting system is provided for securing a metal to metal contact between the support surface and the bracket and absorbing vibrational energy caused by movement of the railroad car. The arrangement includes a bushing having an upstanding neck protruding through a hole formed in the support surface, and a bottom surface having an enlarged central opening provided therein. The enlarged central opening is in communication with a throughbore passing through the neck of the bushing. The arrangement further includes an insert having an expanded head with an internally threaded bore, and a threaded shaft depending from the head. The expanded head of the insert is fixedly received in the enlarged central opening in the bottom surface of the bushing. The threaded shaft of the insert extends through an opening formed in the bracket, and is engaged with a nut acting against an underside of the bracket. A cap washer is disposed upon the neck of the bushing, the cap washer having an aperture aligned with the throughbore in the neck of the bushing. A bolt has a head and a threaded shaft depending from the head and extends through the aligned aperture in the cap washer and the throughbore in the neck of the bushing. The cap washer lies between the head of the bolt and the support surface. A lower surface of the cap washer is held spaced from the support surface. The threaded shaft of the bolt is received in the internally threaded bore of the insert such that tightening of the bolt will compress the bushing beneath the cap washer so as to isolate the support surface from torque, twist and vibration. In the preferred embodiment, the support surface is a running board, and the bushing is constructed of a plastic material.

In another aspect of the invention, a mounting system is provided for securing a support surface to a bracket on the railroad car. The mounting system includes a bushing disposed between the support surface and the bracket. The bushing has an upper portion protruding through a hole in the support surface, and a lower portion carrying an insert retained in the bracket. A bolt has a head positioned above the upper portion of the bushing, and a threaded shaft which passes through the bushing and is threadably received in an internally threaded bore of the insert. The bushing is constructed of an energy absorbing, compressible material. The mounting system includes a cap washer disposed upon the neck of the bushing beneath the head of the bolt in spaced relationship from the support surface. The insert has an expanded head and a threaded shaft depending from the head. The expanded head is fixedly received in an enlarged central opening formed in the lower portion of the bushing. The threaded shaft of the insert extends through an opening formed in the bracket and is engaged with a nut acting against an underside of the bracket. The bracket has an inverted, U-shape provided with a raised surface and a pair of downwardly depending legs fastened to the railroad car. A bottom surface of the bushing is supported upon the raised surface of the bracket.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a partial perspective view of the top of a railroad car employing a prior art mounting system for fastening a running board;

FIG. 2 is a sectional view of the prior art mounting system shown in FIG. 1;

FIG. 6 is a magnified detailed view of FIG. 5;

FIG. 7 is a sectional view showing the assembled mounting system of FIG. 5 on opposite ends of a running board;

FIG. 8*a* is a top view of a bushing employed in the mounting system of the present invention;

DETAILED DESCRIPTION OF THE INVENTION

Prior Art Mounting System

Figure 3:
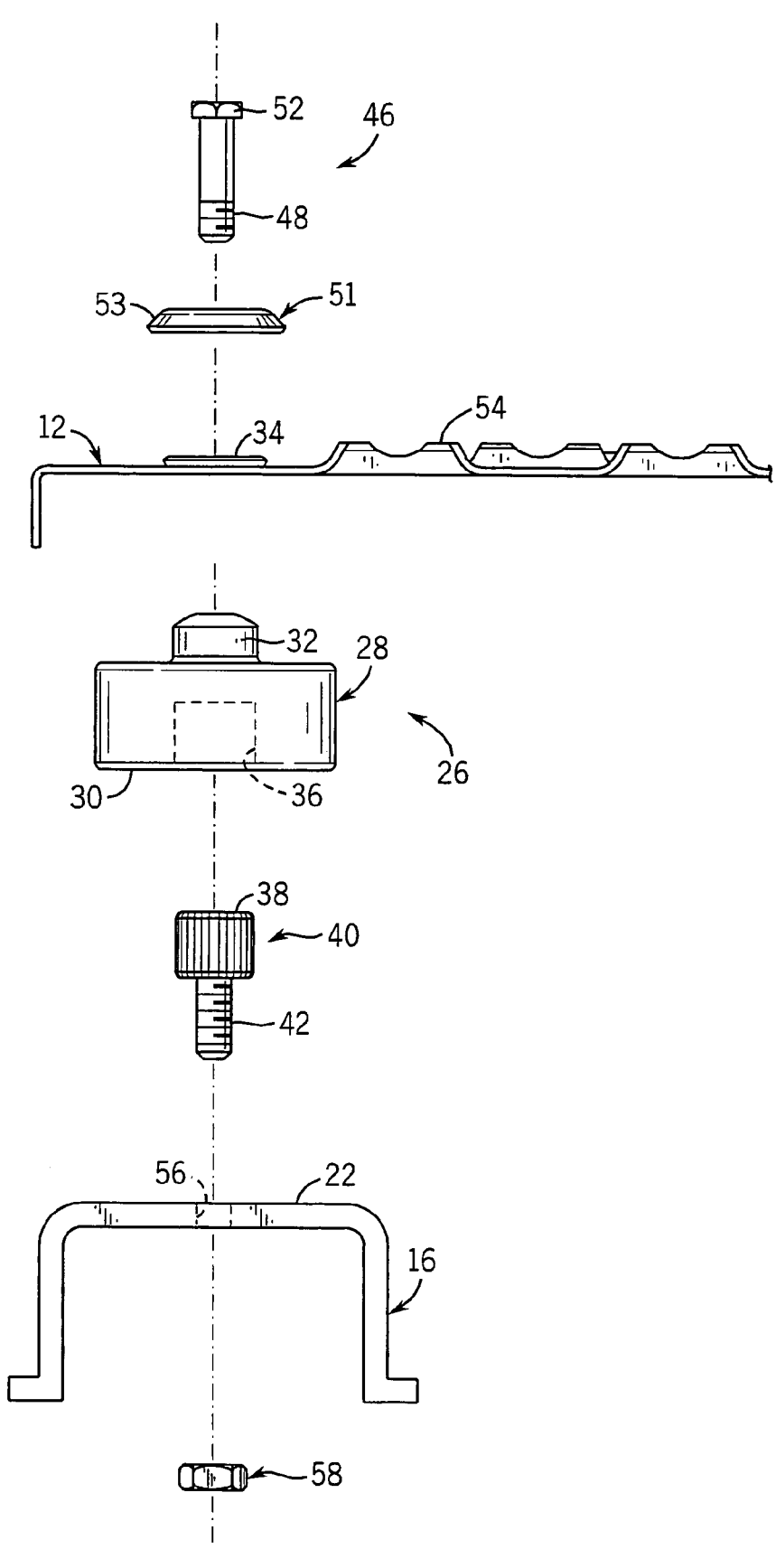
FIG. 3 is an exploded, front view of the isolation mounting system of the present invention.

Referring first to FIG. 1, the top of a railroad car 10 has a pair of perforated metal running boards 12 which run longitudinally on either side of a central bank of pivotable hatch covers 14 used to provide access to the interior of the car 10. The running boards 12 act as support surfaces for operating and service personnel as they open and close the covers 14. The sides of each running board 12 are rigidly fastened to a series of inverted, U-shaped brackets 16 that are welded to the top of the car 10. As seen in FIG. 2, bolts 18 pass through aligned holes in laterally extending flanges 20 of each running board 12 and raised, upper surfaces 22 of brackets 16 with a nut 24 being applied to a threaded portion of each bolt 18 adjacent the underside of each bracket upper surface 22. The bolt 18 and the nut 24 are in direct contact with the running board 12 and the bracket 16. As more fully discussed in the Background of the Invention, such prior art mounting systems contribute to premature failure of the support surfaces 12 by transmitting unwanted vibrational forces which cause fatigue and cracking.

The Present Invention

Referring now to FIG. 3, thereshown is a mounting system 26 of the present invention. The mounting system 26 is particularly useful in mounting the support surface or railroad car running board 12 to the bracket 16 of the railroad car 10. As illustrated in FIG. 3, a generally cylindrical bushing 28 is positioned between the running board 12 and the bracket 16. Specifically, a bottom surface 30 of the bushing 28 contacts the upper surface 22 of the bracket 16. A bushing neck 32 extends upwardly from the bushing 28 and protrudes through a mounting hole 34 formed in the running board 12. Preferably, the bushing 28 is formed from a compressible material such as polyurethane or another suitable plastic.

Figure 5:
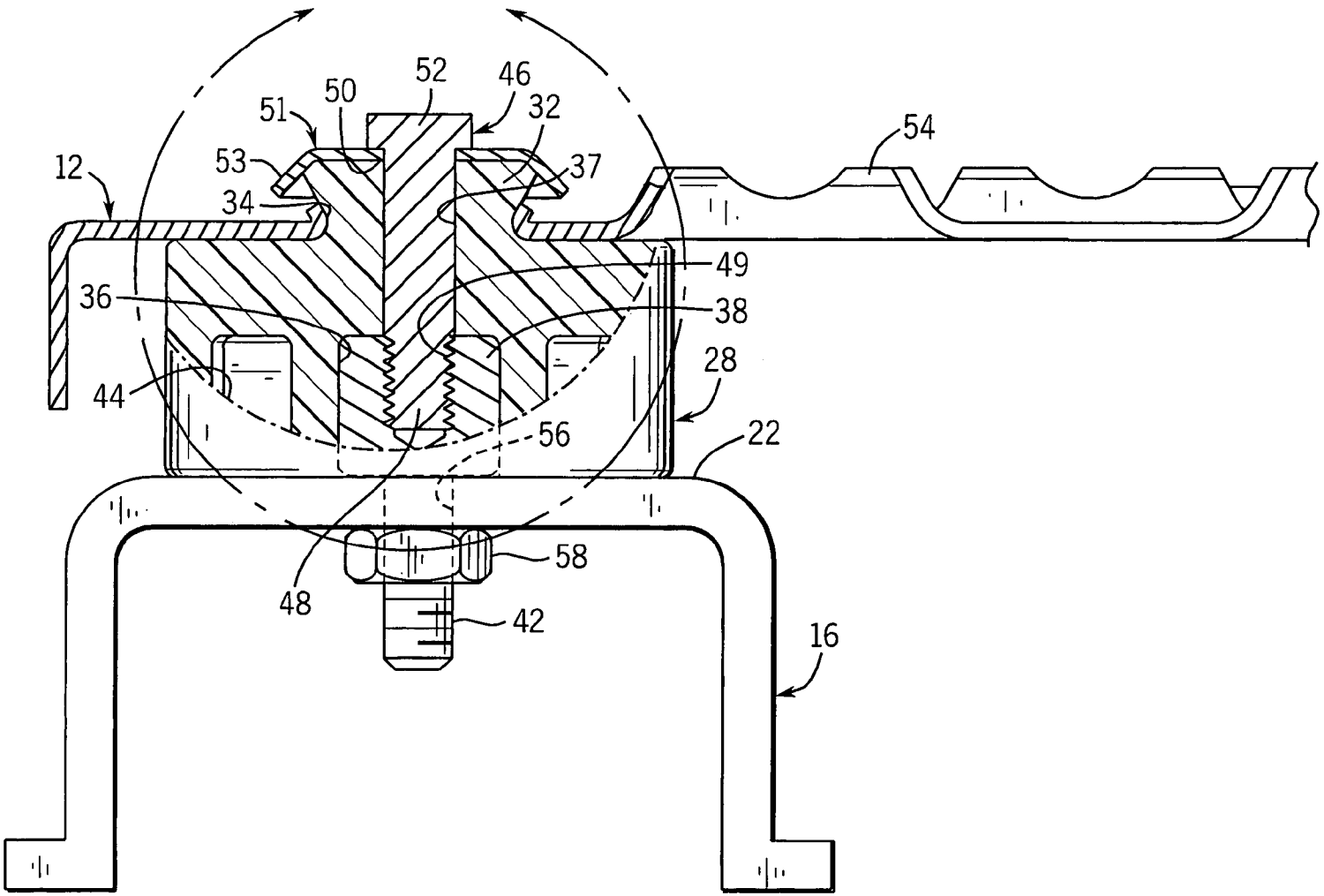
FIG. 5 is an assembled view of the mounting system with a partial cutaway view.
Figure 8B:
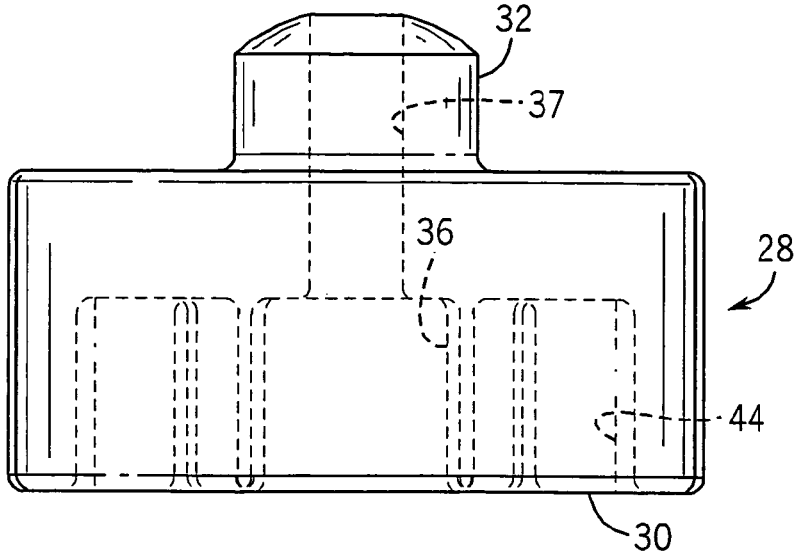
FIG. 8*b* is a front view of the bushing shown in FIG. 8*a;*
Figure 8C:
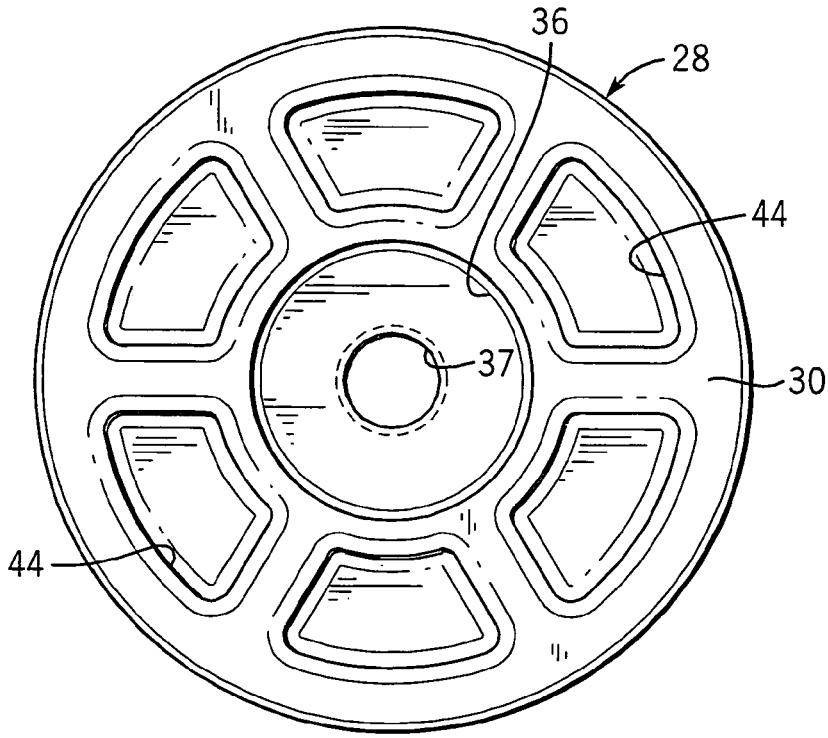
FIG. 8*c* is a bottom view of the bushing shown in FIG. 8*a;*

The bottom surface 30 of the bushing 28 includes an enlarged central opening 36 which is in communication with a throughbore 37 passing through neck 32, as shown in FIGS. 5 and 8*c*. The opening 36 is sized to receive an expanded head 38 of a metal insert 40 having a threaded shaft 42 as best shown in FIGS. 3, 5 and 6. The bottom surface 30 of the bushing 28 also is formed with a series of cavities 44 which surround central opening 36.

Figure 9A:
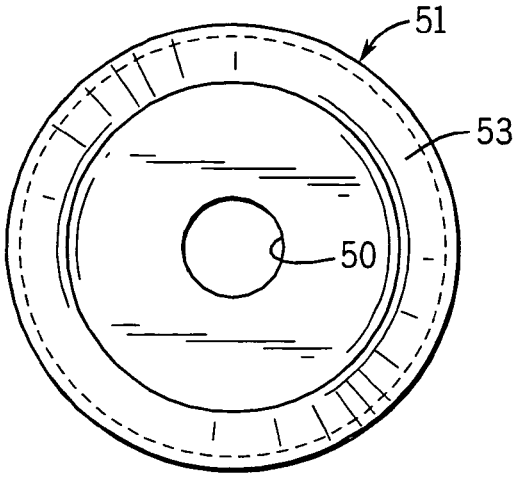
FIG. 9*a* is a top view of a cap washer employed in the mounting system of the present invention.
Figure 9B:
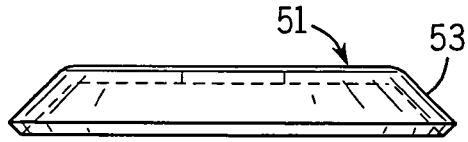
FIG. 9*b* is a front view of the cap washer shown in FIG. 9*a;*
Figure 10B:
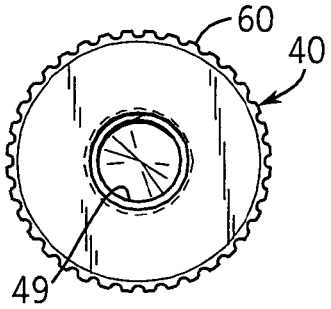
FIG. 10*b* is a top view of the insert shown in FIG. 10*a.*
Figure 10A:
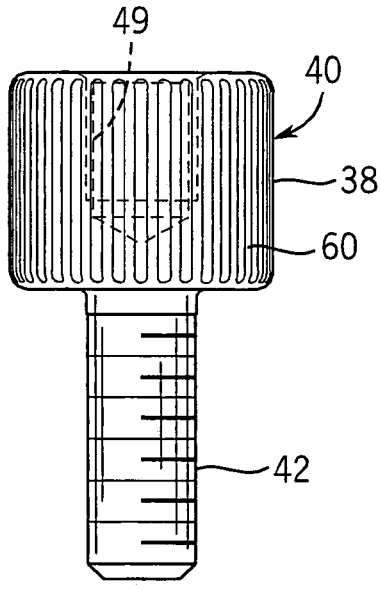
FIG. 10*a* is a front view of an insert employed in the mounting system of the present invention.

A metal bolt 46 extends through the throughbore 37 in the bushing 28 such that a threaded shaft 48 of the bolt 46 is received within an internally threaded bore 49 of the expanded head 38 of the insert 40, as shown in FIGS. 5, 10*a* and 10*b*. Referring to FIG. 5, the bolt 46 also passes through an aperture 50 in an engineered metal cap washer 51 which rests upon the bushing neck 32 and is entrapped between a head 52 of the bolt 46 and an extruded upper lip 54 of the running board 12. The cap washer 51 is formed with a downwardly and outwardly sloping side wall 53 as best seen in FIG. 9*b*. The threaded interaction between the bolt 46 and the head 38 of the insert 40 compresses the bushing 28 beneath the cap washer 51. Referring now to FIG. 5, as the bolt 46 is tightened, the cap washer 51 compresses the neck 32 of the bushing 28 to create a snug fit between the bushing 28 and the running board 12. The compression of the neck 32 can also clearly be seen in FIG. 6.

The amount of compression of the bushing neck 32 is controlled by the tightening of the bolt 46 into the head 38 of the insert 40. It is contemplated that the length of the threaded shaft 48 will be set to control the amount of compression of the neck 32.

The insert 40, in turn, includes the shaft 42 that extends through an opening 56 formed in the bracket 16, and is received by a metal nut 58. The nut 58 holds the insert 40 in place relative to the bracket 16.

As shown in FIGS. 10*a* and 10*b*, the expanded head 38 includes a series of outer ridges 60. The outer ridges 60 function to prevent rotation of the head 38 within the bushing 28 when it is mounted as shown in FIG. 5.

Figure 4:
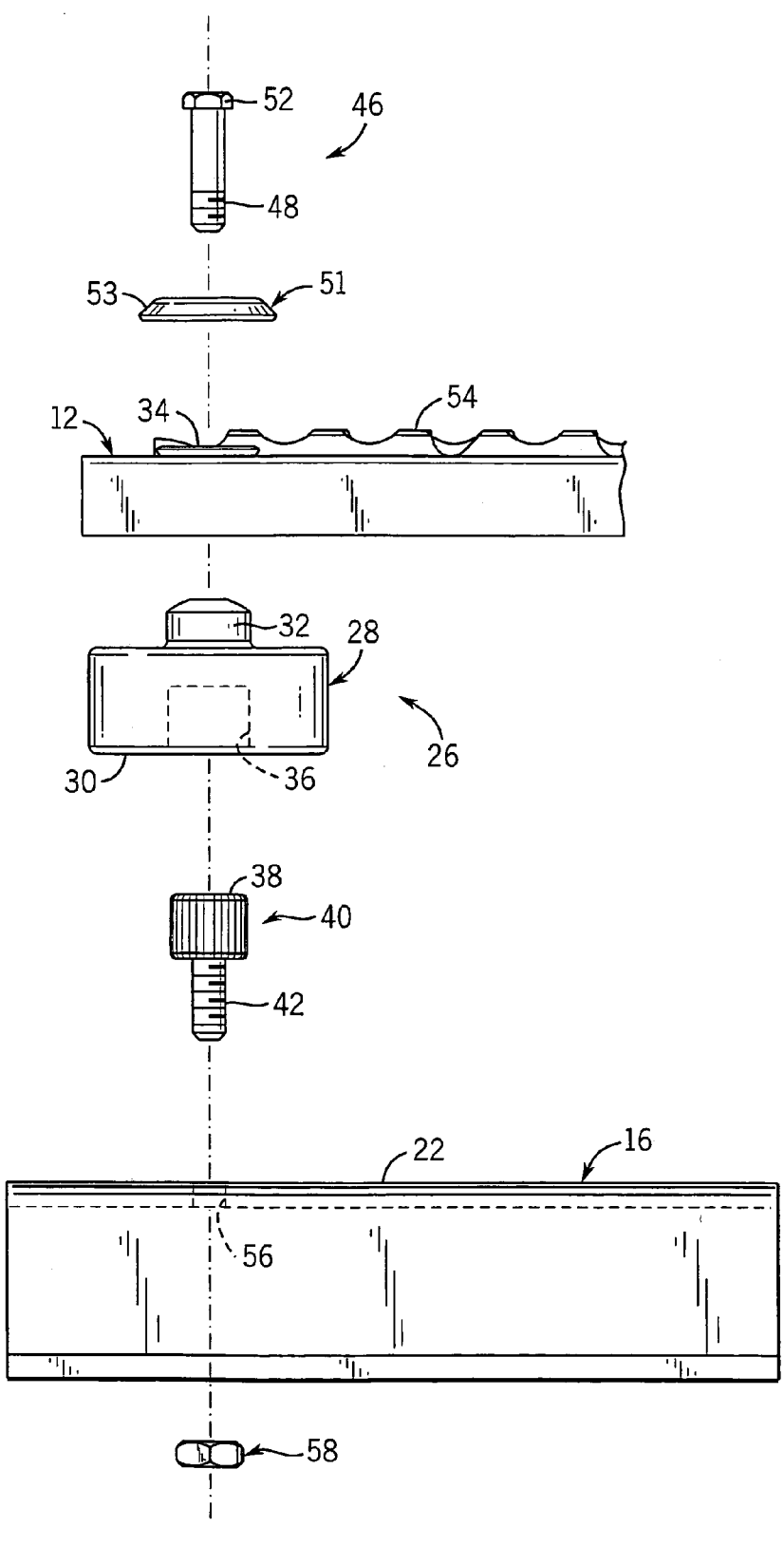
FIG. 4 is a side view of the mounting system shown in FIG. 3.

FIGS. 5 and 6 show detailed views of the mounting system 26 of the present invention, where reference numerals are similar to those used in FIGS. 3 and 4. As can be understood in the drawings, the bushing 28 is designed with a specific hardness that, under compression, isolates the running board 12 from the torque, twist and harmonic vibrations as the railroad car 10 travels along the rail. Further, in contrast with the prior art, metal fastener 46 and washer 51 are not in contact with the metal of the running board 12. Thus, the running board 12 is free of flex, which ultimately fatigues metal and causes cracking, such that movement of the car mounts transmits energy only through the bushing 28 which absorbs this energy. Through this, isolation, twisting, torquing or excess vibration transmitted to the running board 12 is greatly reduced, thus extending the life of each running board 12 significantly.

FIG. 7 illustrates the assembled mounting system 26 on opposite ends of the running board 12.

Although only one pair of mounting systems 26 is shown in FIG. 7 or the running board 12, it should be understood that multiple mounting systems are utilized with each running board 12 depending upon the length and size of the running board 12. It is contemplated by the inventor that a running board 12 will be provided with the bushing 28 and insert 40 attached by the bolt 46 such that the running board 12 can be installed on the existing bracket 16 by simply tightening the nut 58 to each of the shafts 42 of the inserts 40. In this manner, the tightening of the bolts 46 with respect to the bushings 28 can be controlled during manufacture.

In the foregoing description, the railroad car support surface has been set forth in terms of running board 12. However, it should be understood that the term support surface is intended to further embrace various steps as well as platforms and similar support structures to be secured on a railroad car by the mounting system 26 of the present invention.

Various alternatives and embodiments are contemplated as being within the scope of the following claims particularly pointing out and distinctly claiming the subject matter regarded as the invention.

I claim:

1. A mounting system for securing a support surface to a railroad car to isolate the support surface from the twisting and vibration of the railroad car to reduce fatigue of the support surface, the mounting system comprising:

a plurality of compressible, energy absorbing bushings positioned between the support surface and the railroad car such that the support surface is spaced from the railroad car by the plurality of bushings; and a plurality of bolts each associated with one of the bushings, each bolt having an expanded head and a depending shaft, the expanded head being positioned above the support surface and in operative contact with the bushing to isolate the bolt from the support surface, depending shaft extending through the support surface and secured to the railroad car such that the combination of the plurality of bolts and bushings secure the support surface to the railroad car, wherein the plurality of bolts compress the plurality of bushings between the support surface and the railroad car and the plurality of bushings are each further compressed upon relative movement between the support surface and the railroad car to isolate the support surface from the railroad car.

2. The mounting system of claim 1 further comprising a mounting bracket attached to the railroad car, wherein the plurality of bushings are positioned between the support surface and the mounting bracket.

3. The mounting system of claim 1 wherein the expanded head of the bolt is spaced from the support surface by the bushing.

4. The mounting system of claim 1 wherein the support surface is a running board or a step.

5. The mounting system of claim 1 wherein each of the bushings is constructed of plastic or an elastomeric material.

6. The mounting system of claim 1 wherein the threaded shaft of the bolt is received within the bushing and the amount of tightening of the bolt relative to the bushing is limited to restrict the compression of the bushing by the bolt.

7. A mounting system for securing a support surface to a bracket on a railroad car to isolate the support surface from the twisting and vibration of the railroad car to reduce the fatigue of the support surface, the mounting system comprising:

a plurality of compressible, energy absorbing bushings positioned between the support surface and the railroad car, each bushing having an upstanding neck protruding through an opening formed in the support surface; and a plurality of bolts each associated with one of the bushings, each bolt having an expanded head and a depending threaded shaft, the expanded head being positioned in operative contact with the upstanding neck of the bushing to isolate the bolt from the support surface, the threaded shaft extending through the upstanding neck of the bushing and the support surface, the threaded shaft being secured to the railroad car to secure the support surface and the bushing to the railroad car, wherein the expanded head of the boll is spaced from the support surface by the upstanding neck of the bushing such that the plurality of bolts compress the plurality of bushings between the support surface and the railroad car and the plurality of bushings are further compressed upon relative movement between the support surface and the railroad car to isolate the support surface from the railroad car.

8. The mounting system of claim 7 further comprising a cap washer disposed between the expanded head of each bolt and the neck of the bushing.

9. The mounting system of claim 8 wherein tightening of the bolt compresses the upstanding neck of the bushing to expand the upper neck of the bushing past the opening in the support surface to secure the bushing to the support surface.

10. The mounting system of claim 9 wherein the tightening of the bolt is limited to control the compression of the upstanding neck of the bushing.

11. The mounting system of claim 7 wherein the plurality of bushings are each attached to the support surface prior to the attachment of the support surface to the railroad car.

* * * * *